US010862236B2

(12) United States Patent
Kawashima et al.

(10) Patent No.: US 10,862,236 B2
(45) Date of Patent: Dec. 8, 2020

(54) CONNECTOR

(71) Applicant: Yazaki Corporation, Tokyo (JP)

(72) Inventors: Kenichi Kawashima, Makinohara (JP); Keiichiro Kurashige, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/658,721

(22) Filed: Oct. 21, 2019

(65) Prior Publication Data

US 2020/0169022 A1 May 28, 2020

(30) Foreign Application Priority Data

Nov. 22, 2018 (JP) ..... 2018-219506

(51) Int. Cl.

| | |
|---|---|
| ***H01R 13/11*** | (2006.01) |
| ***H01R 24/60*** | (2011.01) |
| ***H01R 13/639*** | (2006.01) |
| ***H01R 13/64*** | (2006.01) |
| ***H01R 12/57*** | (2011.01) |
| ***H01R 13/50*** | (2006.01) |
| ***H01R 13/502*** | (2006.01) |
| *H01R 107/00* | (2006.01) |

(52) U.S. Cl.

CPC ..... *H01R 13/11* (2013.01); *H01R 12/57* (2013.01); *H01R 13/50* (2013.01); *H01R 13/502* (2013.01); *H01R 13/639* (2013.01); *H01R 13/64* (2013.01); *H01R 24/60* (2013.01); *H01R 2107/00* (2013.01)

(58) Field of Classification Search

CPC .... H01R 12/78; H01R 13/11; H01R 13/2435; H01R 13/64; H01R 13/639; H01R 12/57; H01R 13/50; H01R 13/502; H01R 33/7664; H01R 12/716

USPC ..... 439/775

See application file for complete search history.

(56) References Cited

U.S. PATENT DOCUMENTS

| | | | | |
|---|---|---|---|---|
| 6,379,162 | B1 * | 4/2002 | Raypole | H01R 33/7664 188/282.2 |
| 6,749,459 | B2 * | 6/2004 | Urbaniak | H01R 12/78 439/496 |
| 7,874,867 | B2 * | 1/2011 | Takahashi | H01R 13/2435 439/496 |
| 8,393,918 | B2 * | 3/2013 | Cheng | H01R 12/716 439/495 |

FOREIGN PATENT DOCUMENTS

| | | |
|---|---|---|
| JP | 2004-134189 A | 4/2004 |

* cited by examiner

*Primary Examiner* — Jean F Duverne
(74) *Attorney, Agent, or Firm* — Sughrue Mion, PLLC

(57) ABSTRACT

A connector includes an electric wire and a housing having an electric wire accommodating portion which is opened upward and which is configured to hold the electric wire. A folded portion folded back to one side toward a cover of the electric wire is provided at a tip end part of a contact portion of a conductor core wire of the electric wire. A groove that is opened forward and extends in a front-rear direction of the housing is formed on a front end surface located at a front end of the wire accommodating portion of the housing. The folded portion is engaged to the groove so that the electric wire is held by the housing.

5 Claims, 24 Drawing Sheets

CONNECTOR

CROSS REFERENCE TO RELATED APPLICATIONS

This application is based on Japanese Patent Application (No. 2018-219506) filed on Nov. 22, 2018, the contents of which are incorporated herein by reference.

BACKGROUND OF THE INVENTION

1. Field of the Invention

The present invention relates to a connector.

2. Description of the Related Art

In the related art, a connector that includes a housing having a terminal accommodating portion that houses a terminal connected to an electric wire is widely known (see, for example, JP-A-2004-134189). Such a connector needs a retaining mechanism to prevent the terminal accommodated in the terminal accommodating portion from coming off. The retaining mechanism in the connector of JP-A-2004-134189 is formed by engaging a lance (cantilever-shaped elastic piece), which is provided on the housing and faces the inside of the terminal accommodating portion, to a step portion of the terminal.

Recent years have seen an increasing demand for reducing the height of the connector. Herein when a mechanism that utilizes engagement between the lance on the housing and the step portion of the terminal is adopted as the retaining mechanism, a space in an upper-lower direction for providing the lance or the step portion of the terminal is inevitably necessary, which is one factor that hinders the reduction in the height of the connector.

On the other hand, this problem can be solved by removing the retaining mechanism. At this time, it is also important that the flexibility of assembly is not lowered.

SUMMARY OF THE INVENTION

The present invention is made in view of the above circumstances, and an object thereof is to provide a connector having a reduced height and good flexibility of assembly.

In order to achieve the above object, the connector according to the present invention has features of the following (1) to (3).

(1) A connector including:

an electric wire having a conductor core wire and a cover which covers the conductor core wire, the conductor core wire exposed from the electric wire functioning as a contact portion configured to be connected with a mating terminal; and a plate-shaped housing having an electric wire accommodating portion which is opened upward and which is configured to hold the electric wire, in which a folded portion folded back to one side toward the cover is provided at a tip end part of the contact portion;

in which a groove that is opened forward and extends in a front-rear direction of the housing is formed on a front end surface located at a front end of the wire accommodating portion of the housing; and in which the folded portion is engaged to the groove so that the electric wire is held by the housing.

(2) The connector according to (1), in which the electric wire placed in the wire accommodating portion such that the folded portion is located in front of the groove is drawn rearward relative to the housing so that the folded portion is entered into the groove.

(3) The connector according to (1) or (2), in which a planar portion configured to contact the mating terminal is provided on a surface of another side of the contact portion that is opposite to the one side of the contact portion.

According to the connector having the configuration in (1), the height of the connector can be reduced by eliminating a terminal that contacts the mating terminal and bringing the conductor core wire of the electric wire into contact with the mating terminal. Further, the electric wire can be reliably held in the housing simply by placing the electric wire in the wire accommodating portion opened upward and drawing the electric wire rearward. Accordingly, it is possible to provide the connector having a reduced height and good flexibility of assembly of the electric wire without the terminal.

According to the connector having the configuration in (2) described above, it is possible to provide a specific operation required for holding the electric wire in the housing by drawing the electric wire placed in the wire accommodating portion rearward.

According to the connector having the configuration in (3), a contact area can be ensured an increase in contact resistance can be prevented by bringing the mating terminal into contact with the planar portion.

According to the present invention, it is possible to provide a connector having a reduced height and good flexibility of assembly.

The present invention is briefly described above. Details of the present invention will be further clarified by reading a mode (hereinafter, referred to as "embodiment") for carrying out the present invention described below with reference to the accompanying drawings.

DETAILED DESCRIPTION OF THE EXEMPLARY EMBODIMENTS

Embodiment

Figure 1:
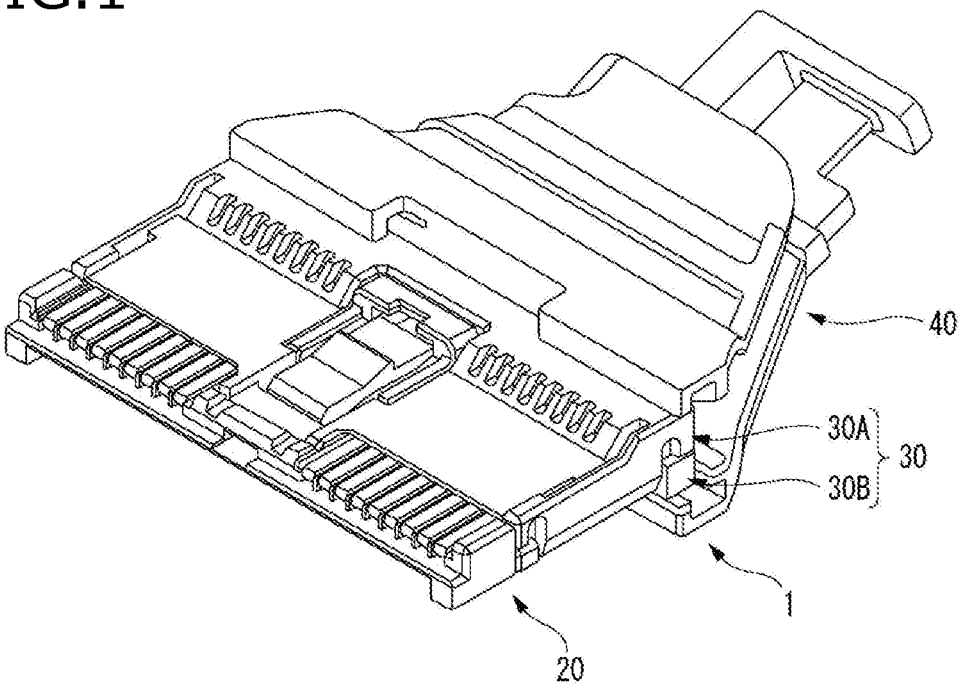
FIG. 1 is a perspective view of a connector according to an embodiment.
Figure 2:
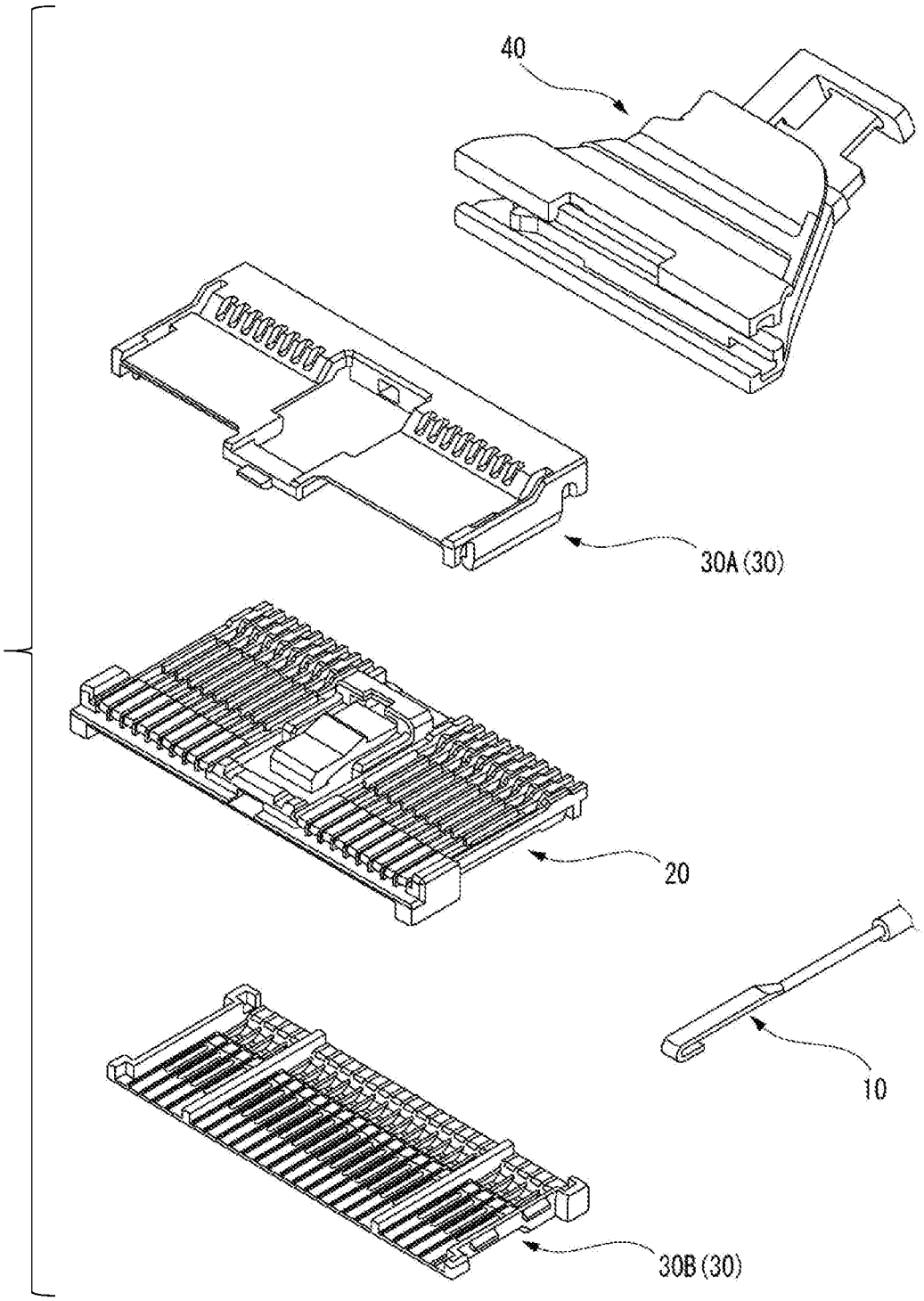
FIG. 2 is an exploded perspective view of the connector in FIG. 1.
Figure 3:
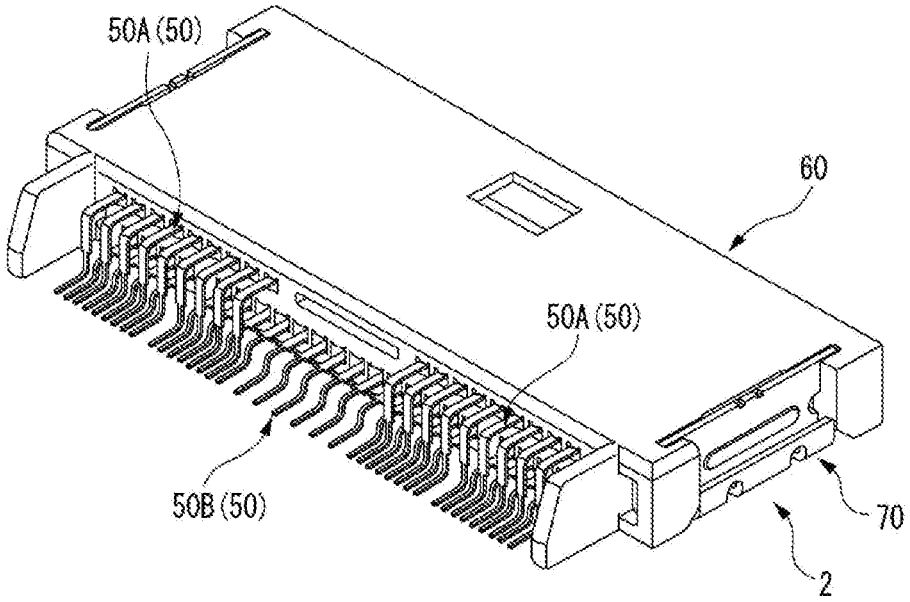
FIG. 3 is a perspective view of a mating connector.
Figure 4:
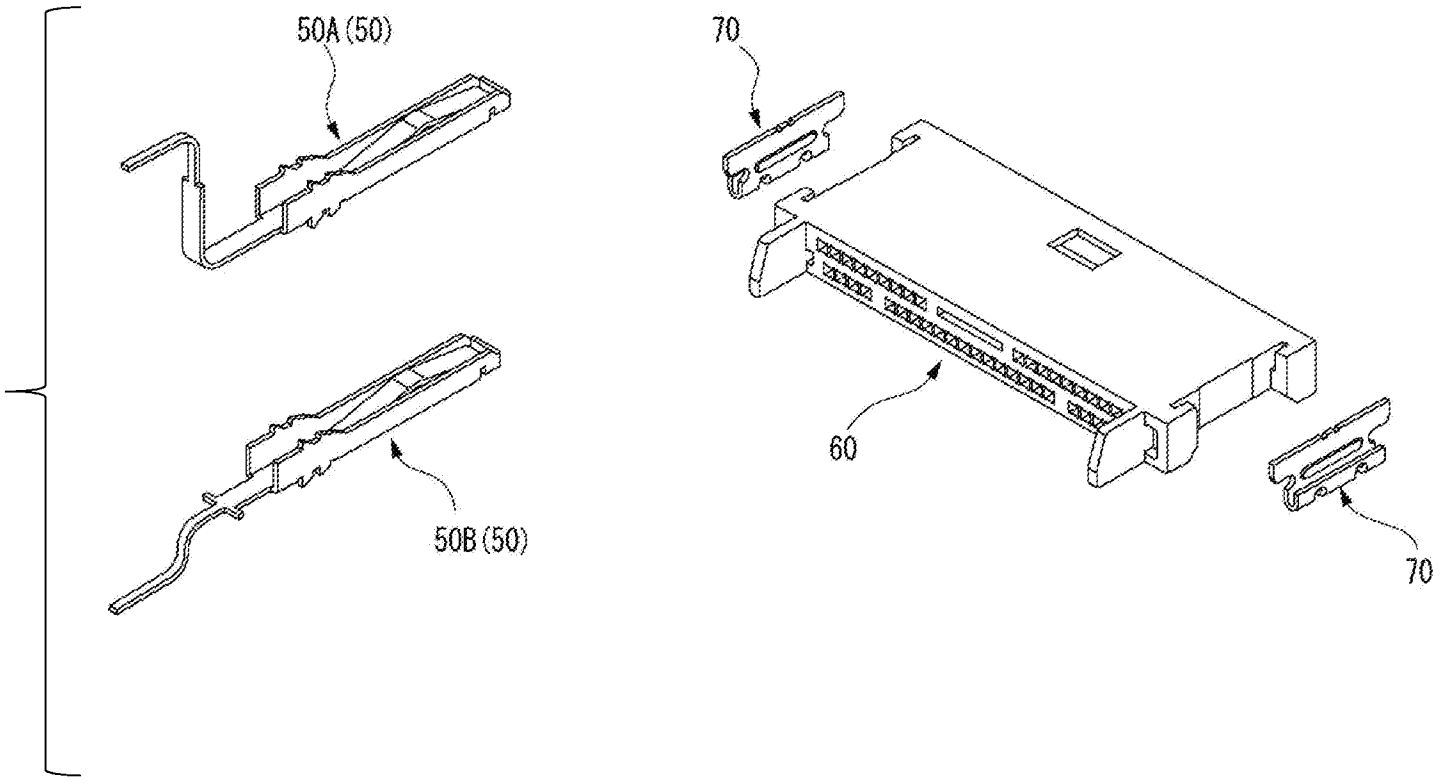
FIG. 4 is an exploded perspective view of the mating connector in FIG. 3.

Hereinafter, a connector 1 according to the embodiment of the present invention will be described with reference to the drawings. As shown in FIG. 2, the connector 1 in FIG. 1 includes an electric wire 10, a housing 20, a cover 30, and a connector cover 40. As shown in FIG. 4, a mating connector 2 in FIG. 3, which is fitted with the connector 1, includes mating terminals 50A and 50B, a mating housing 60, and a pair of pegs 70. The mating housing 60 is mounted and fixed on a substrate (not shown) by the pair of pegs 70. Hereinafter, the mating terminals 50A and 50B may be collectively referred to as a mating terminal 50.

Hereinafter, for convenience of description, the side in the axial direction (fitting direction) of the connector 1 in FIG. 1, into which the mating terminal 50 is inserted (the left side in FIG. 1), is referred to as the front side and the opposite side (the right side in FIG. 1) is referred to as the rear side. The upper side and the lower side in FIG. 1 are referred to as the upper side and the lower side, respectively. Similarly, the side in the axial direction (fitting direction) of the mating connector 2 in FIG. 3, into which the electric wire 10 is inserted (the right side in FIG. 3), is referred to as the front side and the opposite side (the left side in FIG. 3) is referred to as the rear side. The upper side and the lower side in FIG. 3 are referred to as the upper side and the lower side, respectively. Hereinafter, components constituting the connector 1 will be described in order.

Figure 5:
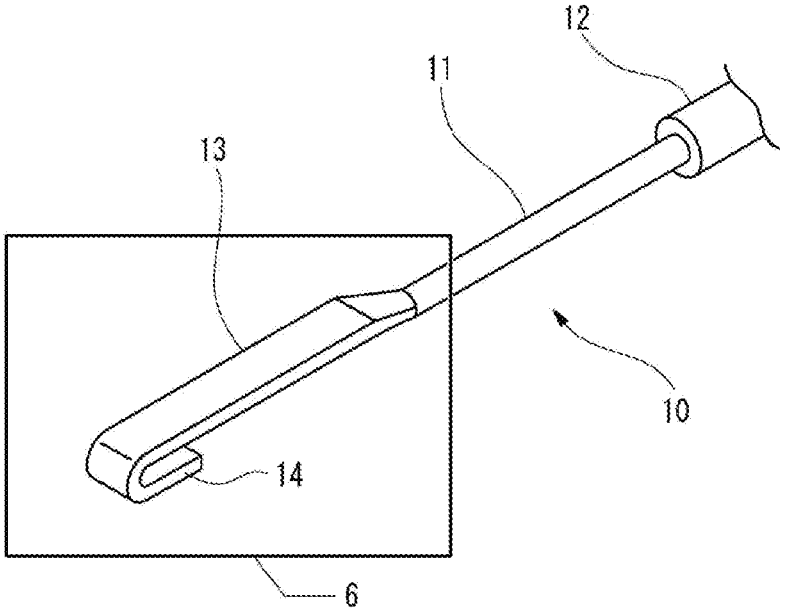
FIG. 5 is a perspective view of an electric wire in FIG. 2.

First, the electric wire 10 will be described with reference to FIGS. 5 to 7. As shown in FIG. 5, the electric wire 10 includes a conductor core wire 11 and a cover 12 that covers the conductor core wire 11. A tip end of the electric wire 10 is subjected to a terminal treatment so that a tip end of the conductor core wire 11 is exposed from the electric wire 10 (cover 12). The conductor core wire 11 is a single-core wire.

The exposed tip end (see FIG. 7) of the conductor core wire 11 is processed into a flat plate shape (a stripe shape extending in the front-rear direction) by press molding, so as to form a contact portion 13 connected to the mating terminal 50. A spring plate 54 (see FIGS. 29A and 29B) of the mating terminal 50 is pressed and brought into contact with a planar portion on the upper surface of the contact portion 13, and thereby the electric wire 10 and the mating terminal 50 are electrically connected.

Figure 6:
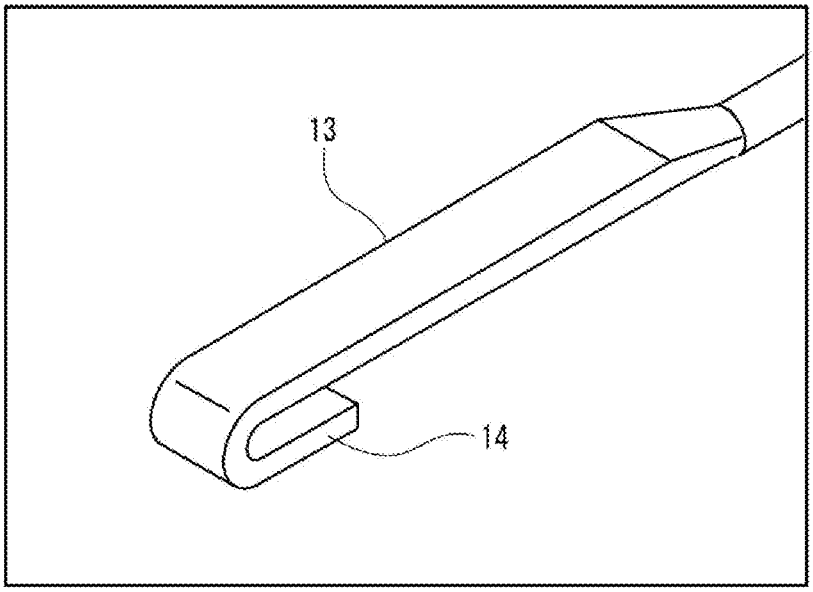
FIG. 6 is an enlarged view of the inside of a frame indicated by a reference numeral 6 in FIG. 5.
Figure 7:
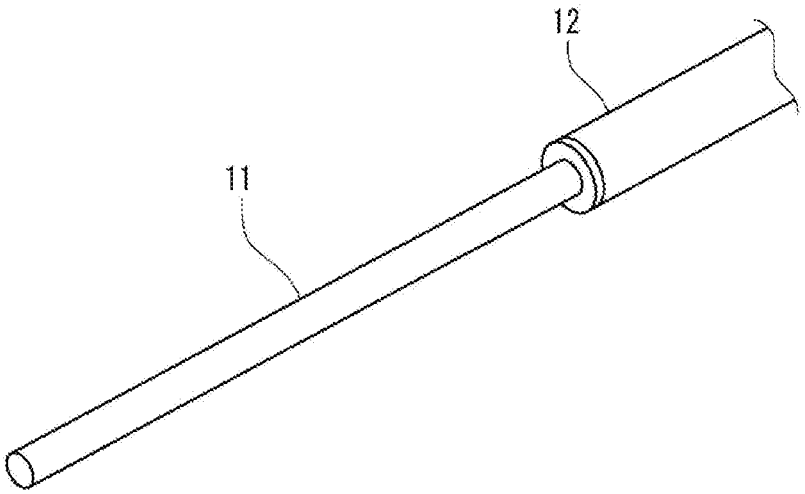
FIG. 7 is a perspective view of the electric wire before a contact portion is formed.

A folded portion 14 folded downward toward the cover 12 is provided at a tip end part of the flat plate-shaped contact portion 13 (particularly, see FIG. 6). As will be described below, the folded portion 14 functions to hold (fix) the electric wire 10 to the housing 20 (see FIG. 16 and the like).

Figure 8:
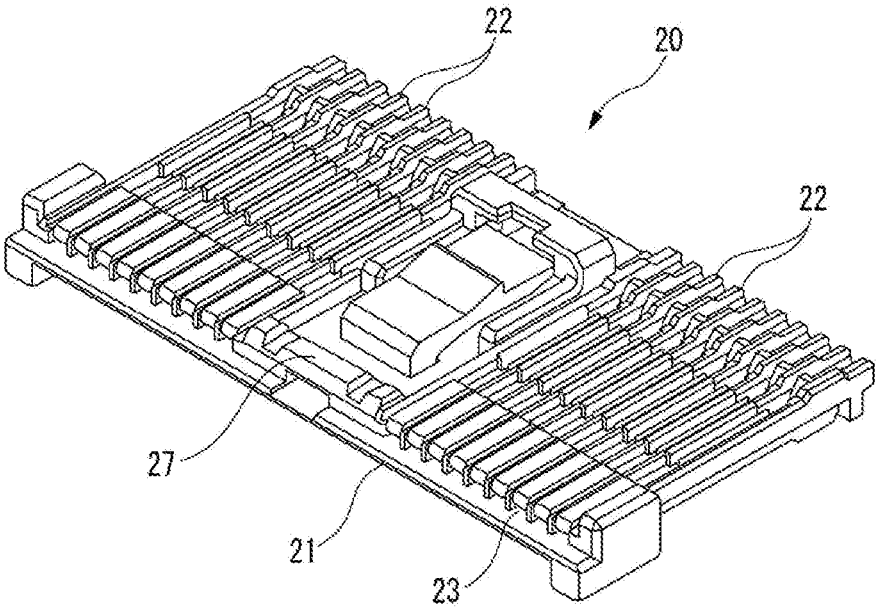
FIG. 8 is a perspective view of a housing in FIG. 2.
Figure 9:
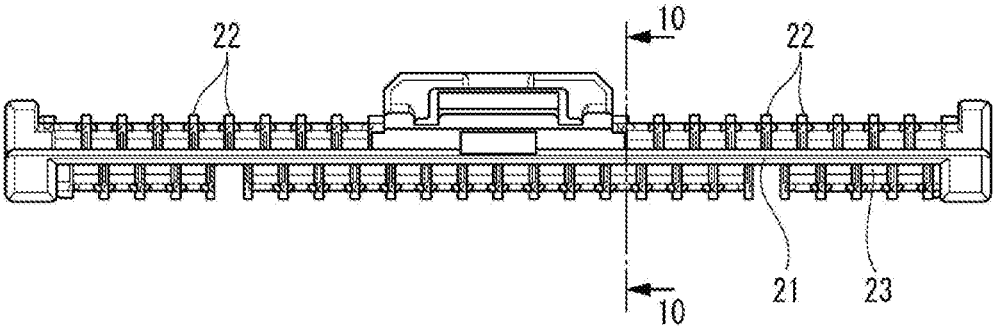
FIG. 9 is a front view of the housing.

Next, the housing 20 will be described with reference to FIGS. 8 to 16. As shown in FIG. 8, the housing 20 includes a rectangular flat plate-shaped housing main body 21. The housing main body 21 includes a plurality of wire accommodating portions that accommodate a plurality of electric wires 10 on each of its upper and lower surfaces. Configurations of the housing main body 21 on the upper surface and the lower surface are substantially the same although there are some differences. Hereinafter, only the configuration of the housing main body 21 on the upper surface will be described below.

A plurality of standing walls 22 extending in the front-rear direction are integrally formed on the upper surface of the housing main body 21 at intervals in the width direction. The standing walls 22 function to partition two wire accommodating portions adjacent in the width direction. That is, on the upper surface of the housing main body 21, the plurality of wire accommodating portions, which are partitioned by the plurality of standing walls 22 and opened upward, are aligned in the width direction.

Figure 10:
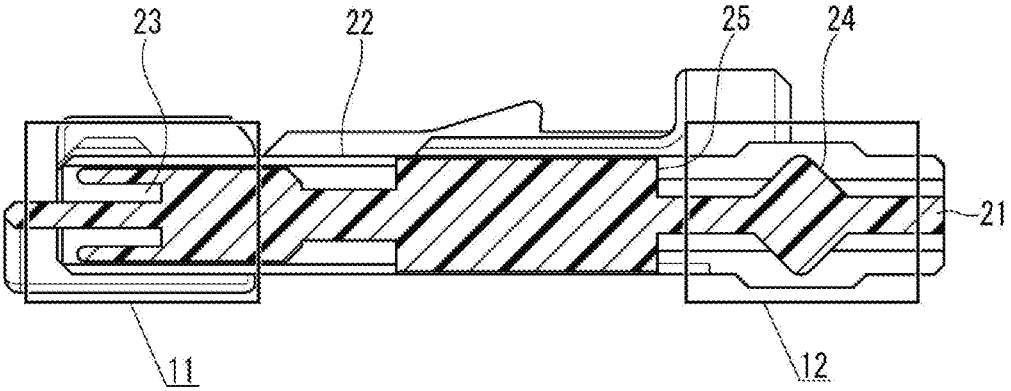
FIG. 10 is a cross-sectional view taken along a line 10-10 in FIG. 9.
Figure 11:
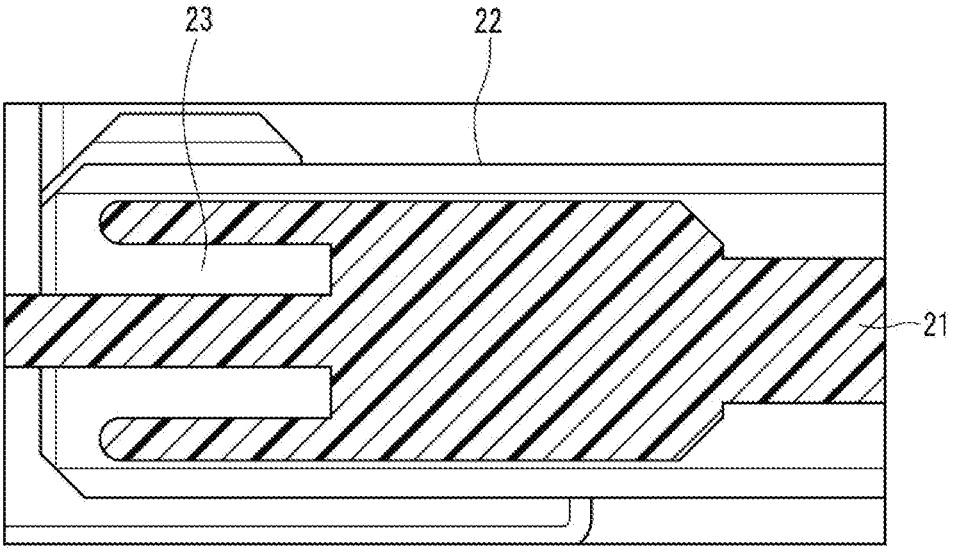
FIG. 11 is an enlarged view of the inside of a frame indicated by a reference numeral 11 in FIG. 10.

As shown in FIGS. 10 and 11 (particularly, FIG. 11), the wire accommodating portions of the housing 20 include, on front end surfaces located at front ends thereof, grooves 23 that are opened forward and extend in the front-rear direction. As will be described below, the grooves 23 function to hold (fix) the electric wires 10 to the housing 20.

Figure 12:
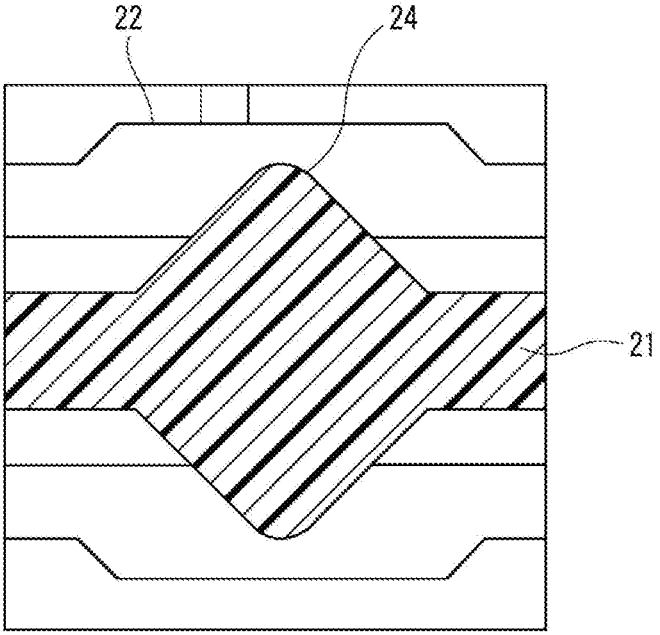
FIG. 12 is an enlarged view of the inside of a frame indicated by a reference numeral 12 in FIG. 10.

As shown in FIGS. 10 and 12 (particularly, FIG. 12), the wire accommodating portions include, on bottom surfaces in the vicinity of rear ends thereof, protrusions 24 for strain relief of the electric wires 10. The strain relief, in this case, means that, even when rearward tensile stress relative to a part of the electric wires 10 in rear of the protrusions 24 is applied, the tensile stress does not act on a part of the electric wires 10 located in front of the protrusions 24.

Figure 13:
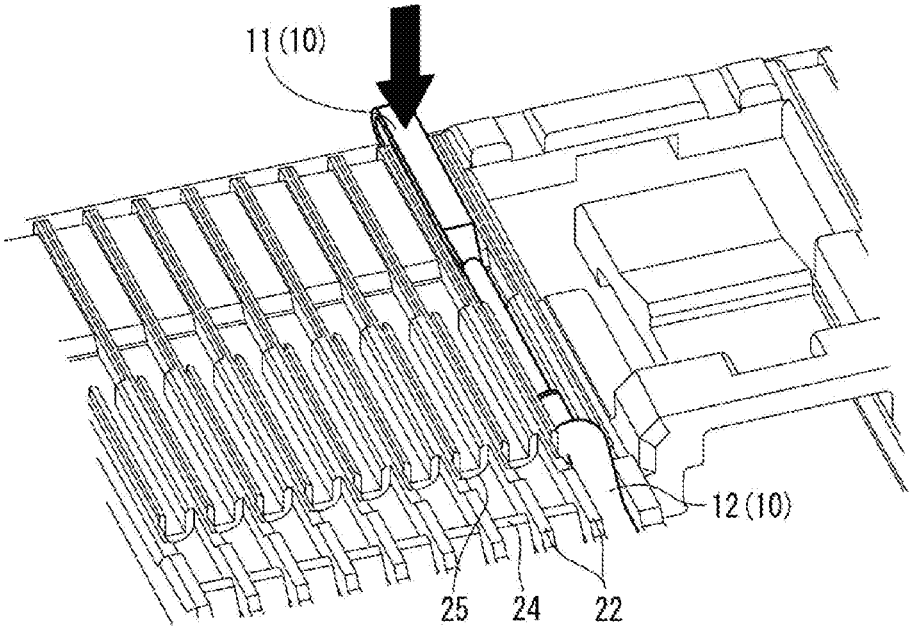
FIG. 13 is a perspective view showing a state in which the electric wire is placed in a wire accommodating portion of the housing.

As shown in FIGS. 10 and 13, the wire accommodating portions include, on positions in rear of centers of the wire accommodating portions in the front-rear direction and in front of the protrusions 24, step portions 25 that prevent the electric wires 10 from coming off forward. Specifically, front end surfaces of the cover 12 of the electric wires 10 are engaged to the step portions 25, so that the electric wires 10 are prevented from coming off forward (see FIGS. 13, 15, and 41).

Figure 14:
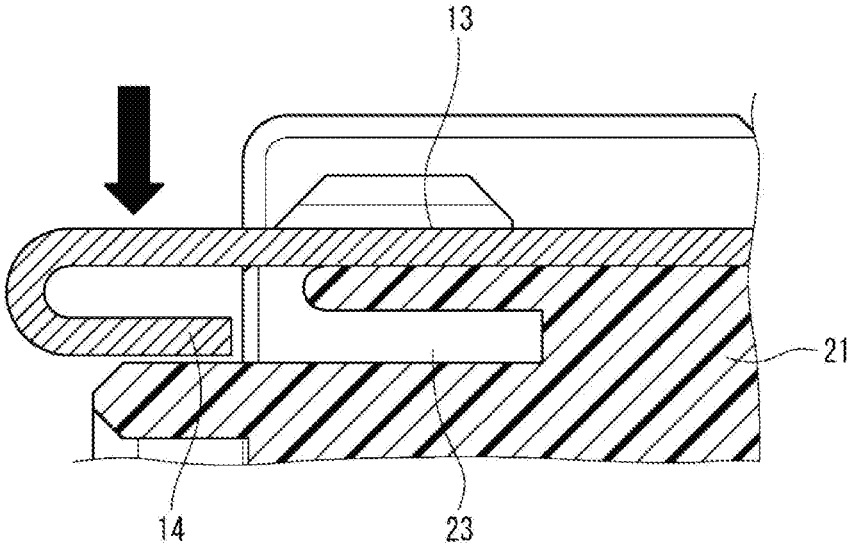
FIG. 14 corresponds to FIG. 11 in the state of FIG. 13.

Hereinafter, procedures for holding (fixing) the electric wires 10 to the housing 20 will be described with reference to FIGS. 13 to 16. First, as shown in FIGS. 13 and 14, the electric wires 10 are placed in the wire accommodating portions such that the folded portion 14 of the contact portion 13 is located in front of the grooves 23.

Figure 15:
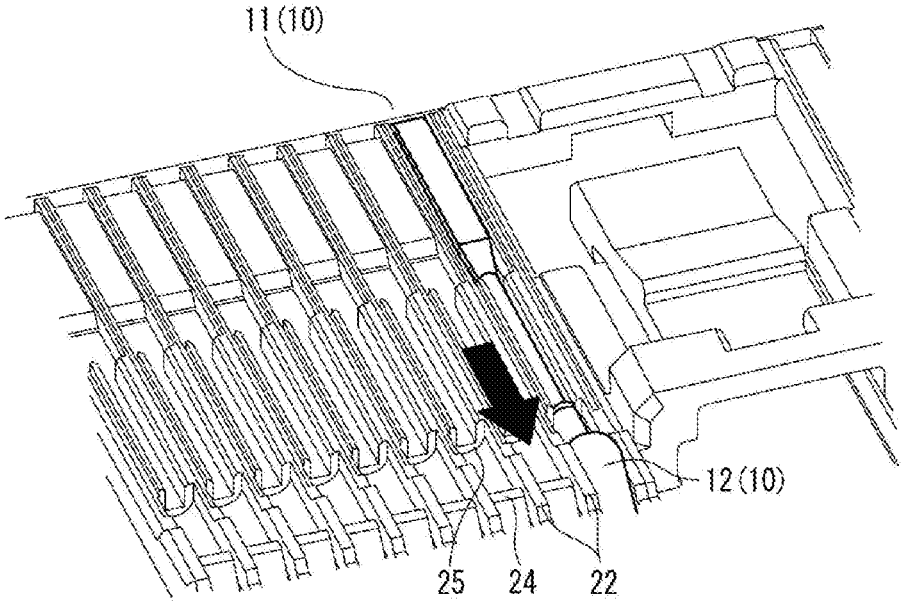
FIG. 15 is a perspective view showing a state in which the electric wire placed in the wire accommodating portion is drawn rearward.
Figure 16:
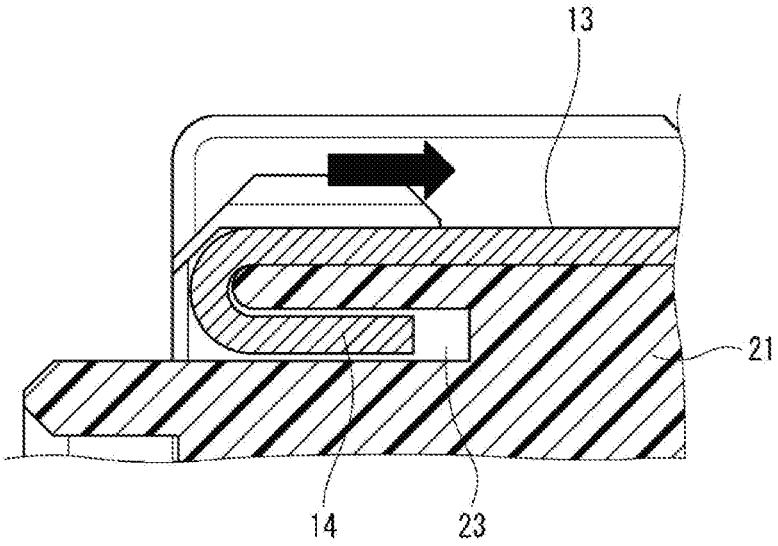
FIG. 16 corresponds to FIG. 11 in the state of FIG. 15.

Next, as shown in FIGS. 15 and 16, the electric wires 10 are drawn rearward relative to the housing 20 from this state until a root portion of the folded portion 14 abuts on end edges (the front end surface of the housing 20) of the grooves 23. As a result, the folded portion 14 is engaged to the grooves 23 (particularly, see FIG. 16). As a result, the electric wires 10 are held (fixed) to the housing 20.

Next, the cover 30 will be described with reference to FIGS. 17 to 27. In this embodiment, an upper cover 30A and a lower cover 30B are used as the cover 30 (see FIG. 2). The upper cover 30A is assembled to the upper surface of the housing main body 21 to cover upper sides of terminal accommodating portions on the upper surface, and the lower cover 30B is assembled to the lower surface of the housing main body 21 to cover lower sides of terminal accommodating portions on the lower surface.

Figure 17:
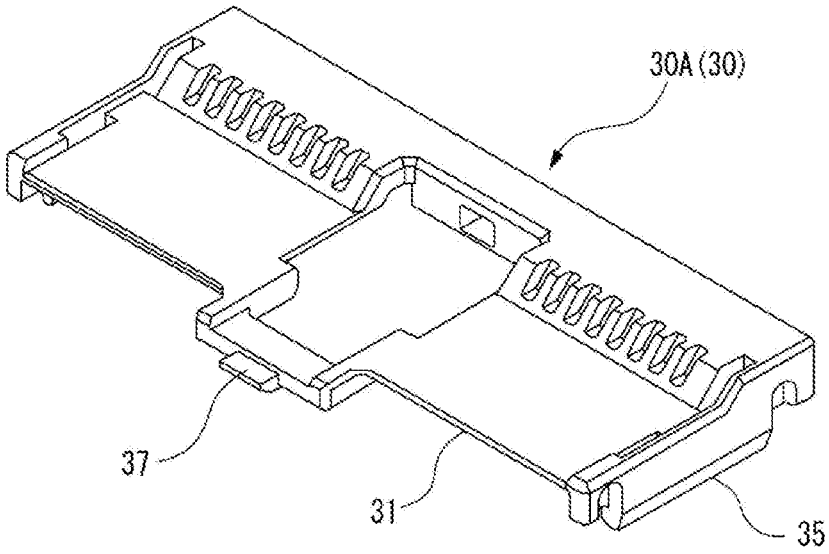
FIG. 17 is a perspective view of an upper cover in FIG. 2.
Figure 18:
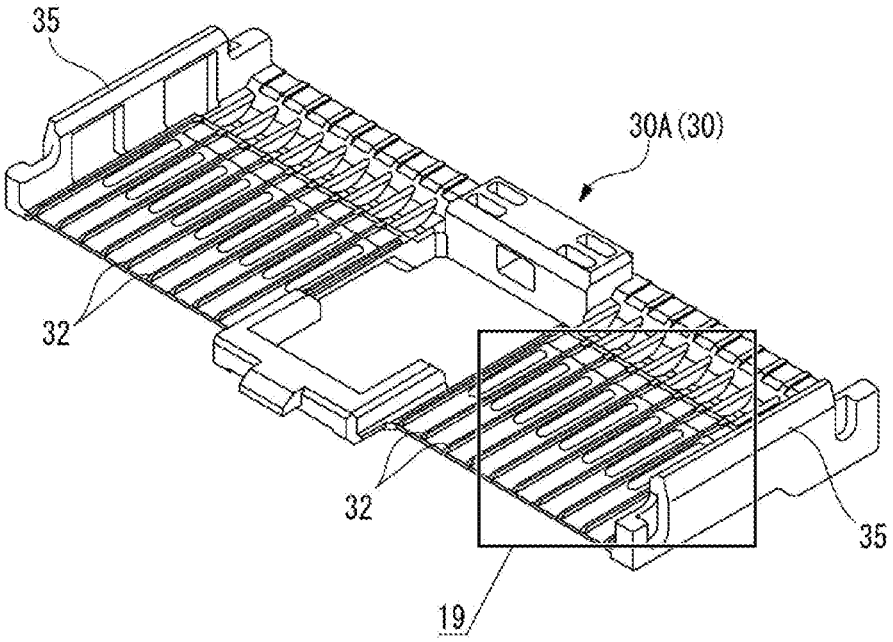
FIG. 18 is a perspective view of the reversed upper cover.

First, the upper cover 30A will be described with reference to FIGS. 17 to 19. FIG. 17 shows the upper cover 30A in the direction of assembly to the housing main body 21 and FIG. 18 shows the reversed upper cover 30A.

The upper cover 30A includes a substantially flat plate-shaped cover main body 31. A plurality of standing walls 32 extending in the front-rear direction are integrally formed on a lower surface of the cover main body 31 at intervals in the width direction and correspond to the standing walls 22 of housing main body 21. Accordingly, when the upper cover 30A is assembled to the housing 20, the upper sides of the terminal accommodating portions of the housing main body 21 are covered by the upper cover 30A, so that the terminal accommodating portions having a cylindrical shape continuous in the front-rear direction are formed.

Figure 19:
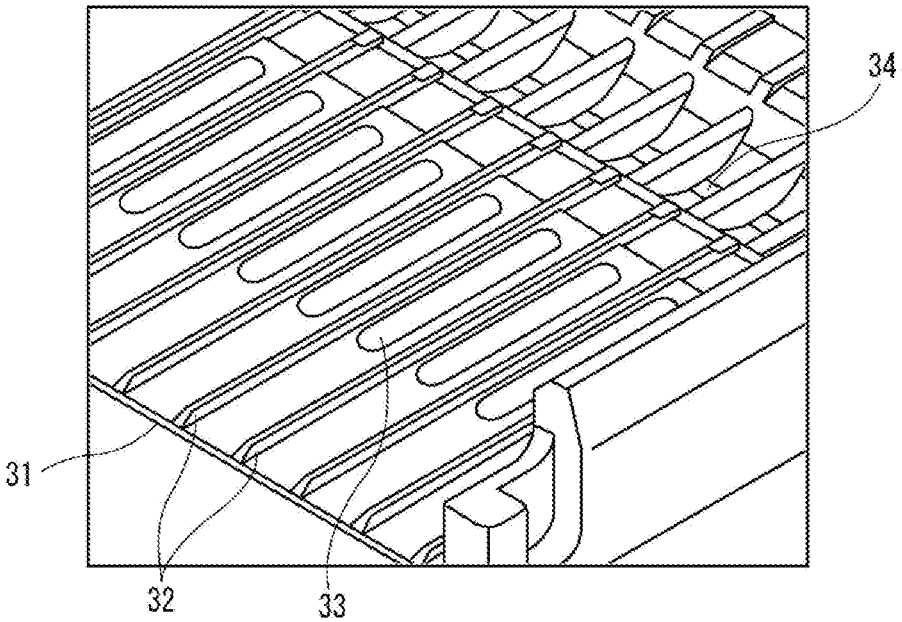
FIG. 19 is an enlarged view of the inside of a frame indicated by a reference numeral 19 in FIG. 18.

As shown in FIG. 19, the cover main body 31 of the upper cover 30A includes, in an integral manner on the substantially central part in the front-rear direction of the lower surface, a plurality of protruding portions 33 protruding downward and extending in the front-rear direction at positions (positions between adjacent standing walls 32) of a plurality of terminal accommodating portions in the width direction. As will be described below, when the upper cover 30A is assembled to the housing 20, the protruding portions 33 function to press the exposed conductor core wire 11 (a part in rear of the contact portion 13) of the electric wires 10 toward the housing 20 to fix the electric wires 10.

As shown in FIG. 19, the cover main body 31 of the upper cover 30A includes, in an integral manner on a part in the vicinity of the rear end of the lower surface, a plurality of recessed portions 33 recessed upward at positions (positions between adjacent standing walls 32) of the plurality of terminal accommodating portions in the width direction. As will be described below, when the upper cover 30A is assembled to the housing 20, the recessed portions 34 function to achieve strain relief of the electric wires 10 in cooperation with the protrusions 24 of the housing 20.

The cover main body 31 of the upper cover 30A includes, in an integral manner at two ends in the width direction, engagement portions 35 that engage respectively with engagement portions 36 (see FIG. 20) of the lower cover 30B when the upper cover 30A is assembled to the housing 20. The cover main body 31 of the upper cover 30A includes, in an integral manner at its front end, an engagement portion 37 that engages with an engagement portion 27 (see FIG. 8) of the housing 20 when the upper cover 30A is assembled to the housing 20.

Figure 20:
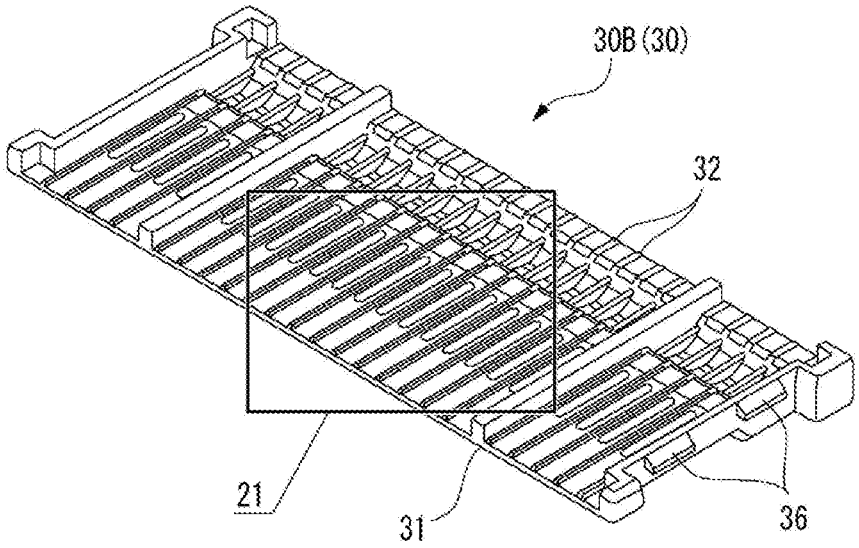
FIG. 20 is a perspective view of a lower cover in FIG. 2.
Figure 21:
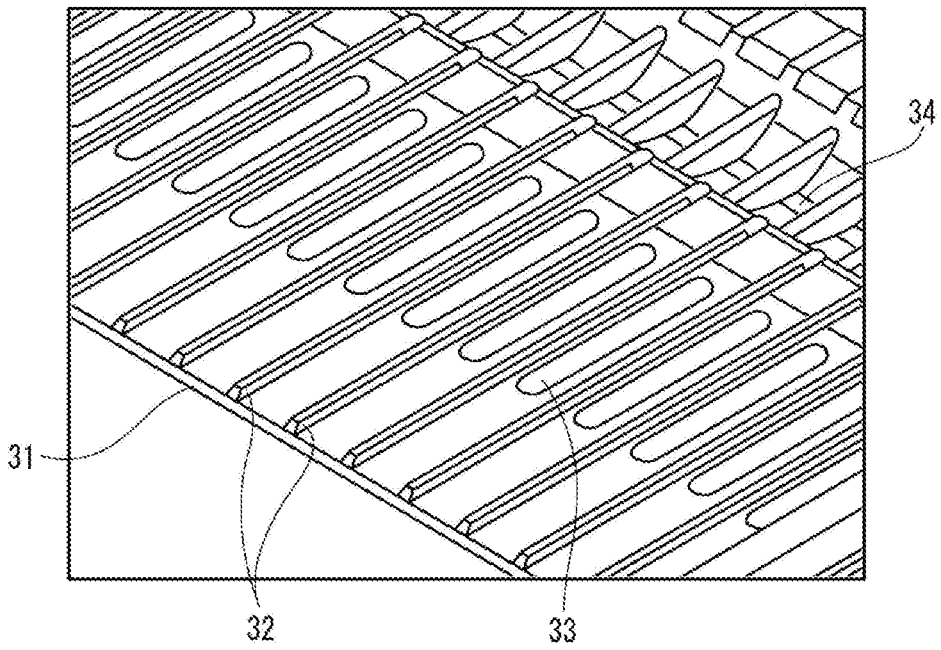
FIG. 21 is an enlarged view of the inside of a frame indicated by a reference numeral 21 in FIG. 20.
Figure 22:
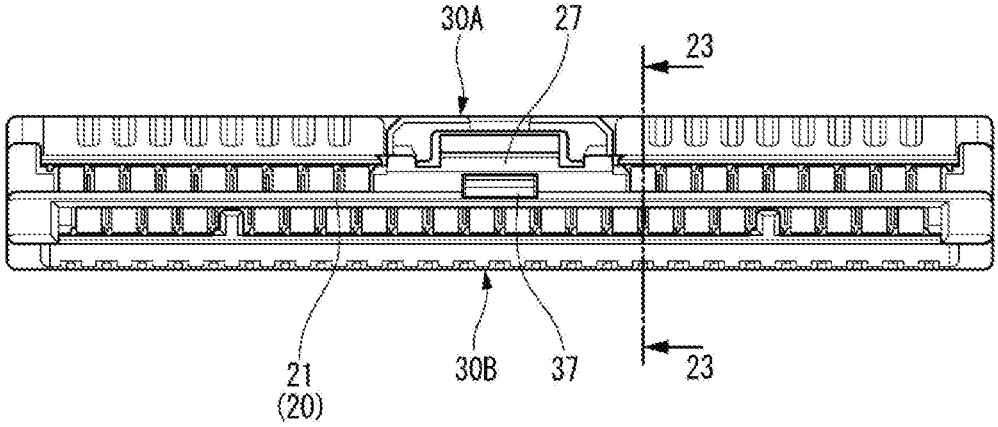
FIG. 22 is a front view of the connector in FIG. 1.
Figure 23:
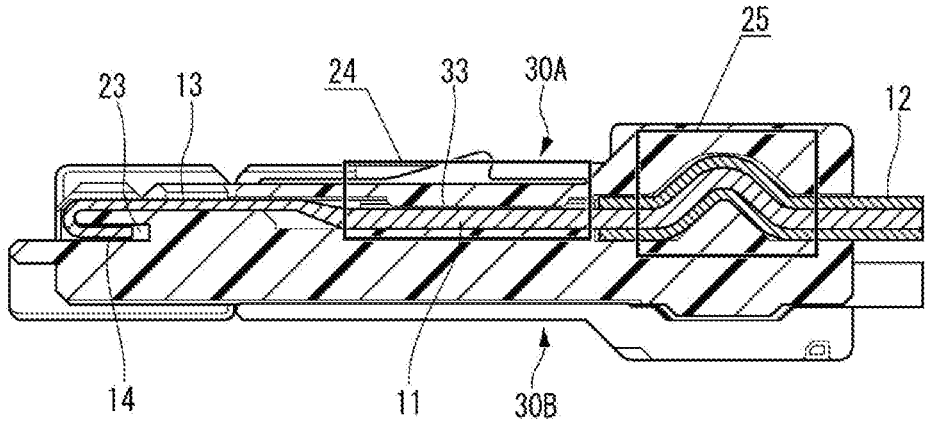
FIG. 23 is a cross-sectional view taken along a line 23-23 in FIG. 22.

Next, the lower cover 30B will be described with reference to FIGS. 20 to 21. FIG. 20 shows the lower cover 30B in the direction of assembly to the housing main body 21. Configurations of the upper cover 30A and the lower cover 30B are substantially the same although there are some differences, except that the upper cover 30A and the lower cover 30B are symmetrical in the upper-lower direction. Therefore, the lower cover 30B is given the same reference numerals as the upper cover 30A for configurations corresponding to those of the upper cover 30A, and the descriptions thereof will be omitted.

As shown in FIGS. 22 to 27, when the upper cover 30A and the lower cover 30B are assembled to the housing 20, the engagement portion 37 (see FIG. 17) of the upper cover 30A and the engagement portion 27 (see FIG. 8) of the housing 20 are engaged to each other, and the plurality of engagement portions 35 of the upper cover 30A and the plurality of engagement portions 36 of the lower cover 30B are engaged to each other. With such cooperation, each of the upper cover 30A and the lower cover 30B is assembled in an immovable manner relative to the housing 20, and the upper cover 30A and the lower cover 30B are assembled in an immovable manner relative to each other.

Figure 24:
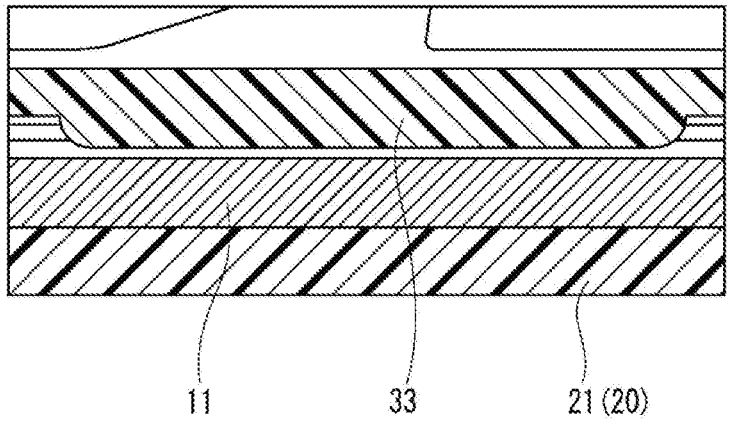
FIG. 24 is an enlarged view of the inside of a frame indicated by a reference numeral 24 in FIG. 23.
Figure 26:
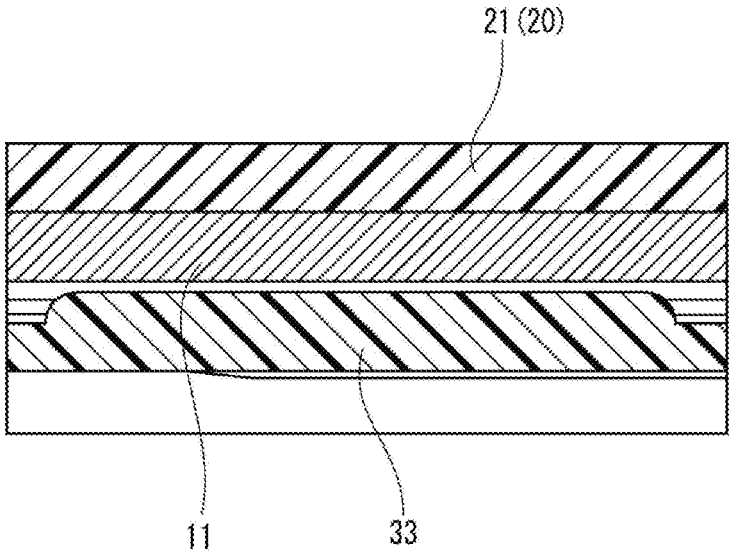
FIG. 26 corresponds to FIG. 24 on the lower cover side.

Further, as shown in FIGS. 24 and 26, the protruding portions 33 of the upper cover 30A and the lower cover 30B press the exposed conductor core wire 11 (a part in rear of the contact portion 13) of the electric wires 10 toward the housing 20. As a result, the electric wires 10 are reliably fixed to the housing 20.

Figure 25:
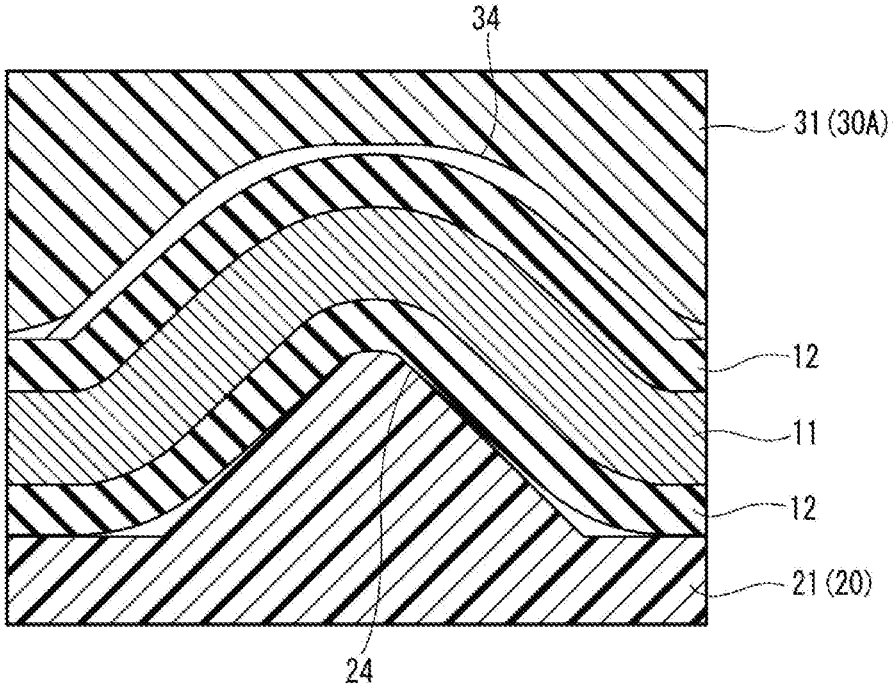
FIG. 25 is an enlarged view of the inside of a frame indicated by a reference numeral 25 in FIG. 23.
Figure 27:
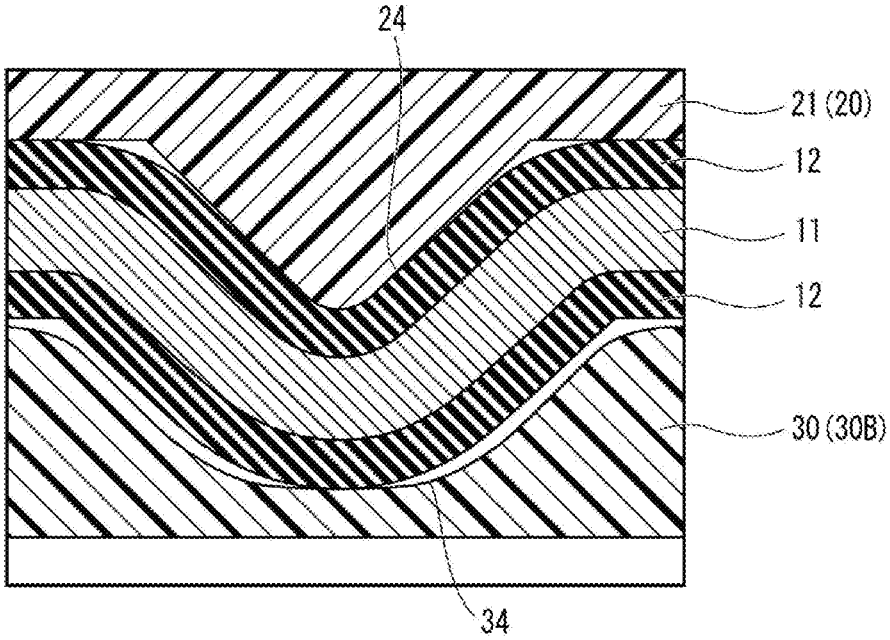
FIG. 27 corresponds to FIG. 25 on the lower cover side.

Further, as shown in FIGS. 25 and 27, the recessed portions 34 of the upper cover 30A and the lower cover 30B press the electric wires 10 in the upper-lower direction in cooperation with the protrusions 24 of the housing 20, so that the electric wires 10 protrude in a chevron shape. As a result, strain relief of the electric wires 10 is achieved.

Figure 28:
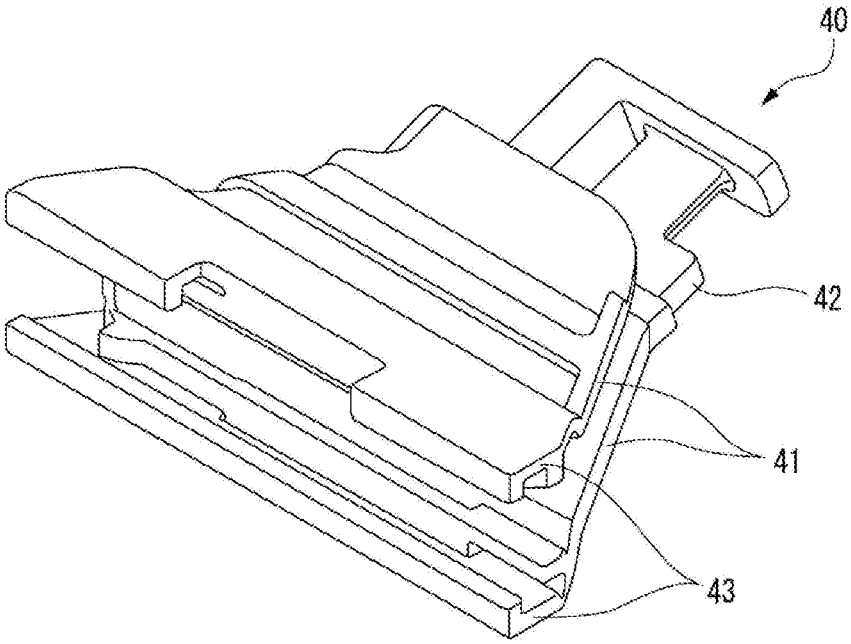
FIG. 28 is a perspective view of a connector cover in FIG. 2.

Next, the connector cover 40 will be described with reference to FIG. 28. The connector cover 40 includes a pair of plate-shaped wire accommodating portions 41 facing each other in the upper-lower direction and a wire holding portion 42 integrally extending on the rear side of the lower accommodating portion 41. Engagement portions 43 provided on front ends of the pair of wire accommodating portions 41 are attached to engagement portions (not shown) provided on rear ends of the upper cover 30A and the lower cover 30B assembled to the housing 20, so that the connector cover 40 is fixed to the housing 20 while protruding rearward from the rear end surface of the housing 20 (see FIG. 1).

The pair of wire accommodating portions 41 have a function of accommodating and protecting the plurality of electric wires 10 extending rearward from the housing 20. The wire holding portion 42 is used to bundle and hold the plurality of electric wires 10 extending rearward from the housing 20. The plurality of electric wires 10 extending rearward from the housing 20 are bundled using a tie band or the like and are held in the wire holding portion 42 (not shown). The connector 1 is described as above.

Next, components constituting the mating connector 2 in FIGS. 3 and 4 will be described in order with reference to FIGS. 29A to 38.

Figure 29A:
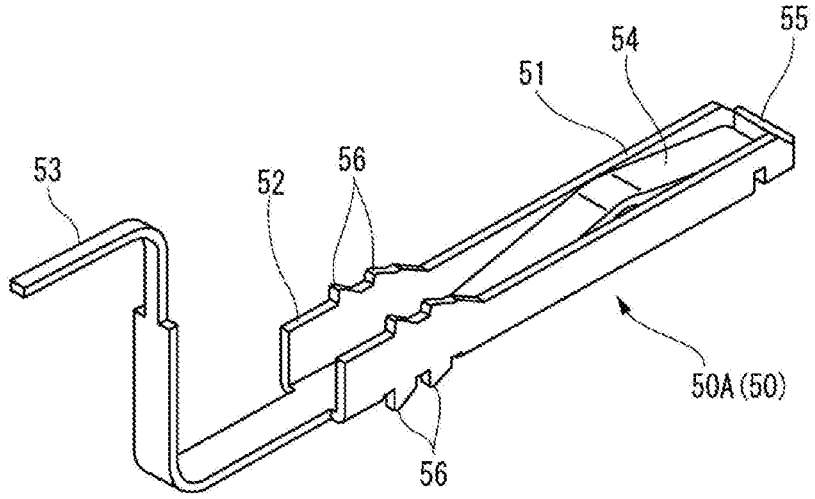
FIG. 29A is a perspective view of a first mating terminal in FIG. 4.
Figure 29B:
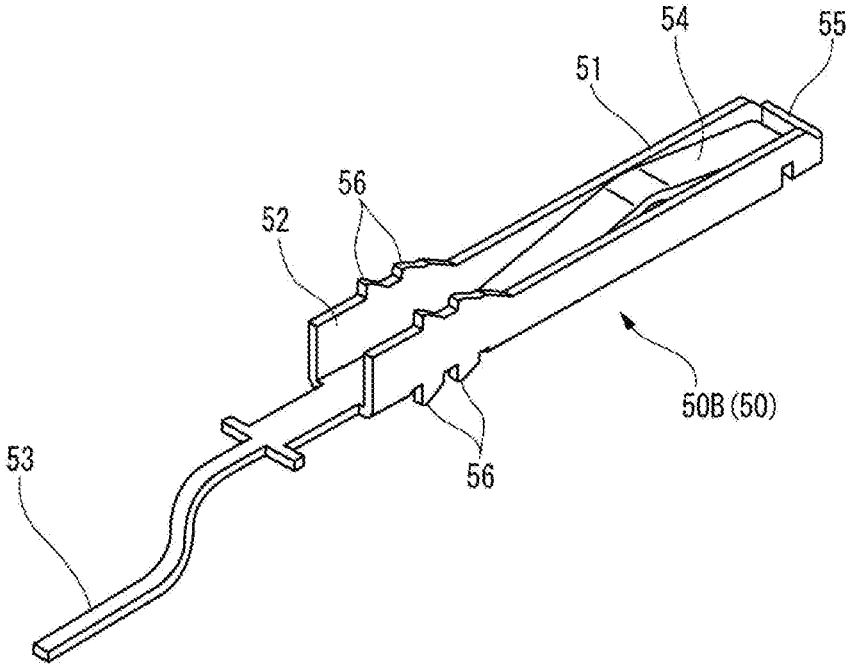
FIG. 29B is a perspective view of a second mating terminal in FIG. 4.

First, the mating terminal 50 will be described with reference to FIGS. 29A to 30. As shown in FIGS. 29A and 29B, in this embodiment, the mating terminal 50A in FIG. 29A and the mating terminal 50B in FIG. 29B are used as the mating terminal 50. The mating terminal 50A is inserted into upper terminal accommodating holes 62 of upper and lower terminal accommodating holes 62 (see FIG. 32) formed in the mating housing 60, and the mating terminal 50B is inserted into the lower terminal accommodating holes 62.

The mating terminals 50A and 50B, which are male terminals formed by pressing, bending a plate-shaped metal member or the like, each include a connecting portion 51 that contacts the contact portion 13 (see FIG. 6) of the electric wires 10, a press-fitting portion 52 continuous to the rear side of the connecting portion 51, and a tab portion 53 continuous to the rear side of the press-fitting portion 52.

The spring plate 54 formed by bending a strip-shaped metal plate is disposed on the connecting portion 51 of the mating terminal 50A and 50B. The top of the spring plate 54 contacts the contact portion 13 of the electric wires 10. A protective wall 55 that protects the spring plate 54 is provided at the front end of the connecting portion 51. The protective wall 55 has a function of preventing a bent portion on the front side of the spring plate 54 from deforming when an external force is applied to the bent portion.

Figure 30:
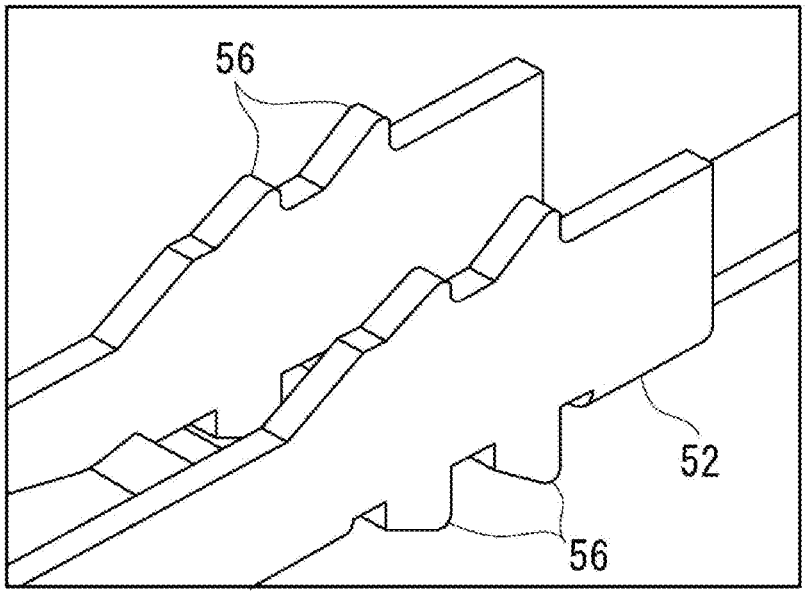
FIG. 30 is an enlarged view of a press-fitting portion of a mating terminal in FIGS. 29A and 29B.

The press-fitting portion 52 of the mating terminals 50A and 50B is provided with a plurality of claw portions 56 protruding in the upper-lower direction on both upper and lower sides of a pair of side walls extending in the upper-lower direction (particularly, see FIG. 30). As will be described below, when the mating terminal 50 is inserted into the terminal accommodating holes 62, the claw portions 56 are press-fitted into press-fitting step portions 64 provided in the terminal accommodating holes 62.

The tab portion 53 of the mating terminals 50A and 50B is bent into a crank shape. When the mating housing 60 is mounted on a substrate (not shown), the tip end of the tab portion 53 extending in the front-rear direction is connected to a circuit of the substrate.

Figure 31:
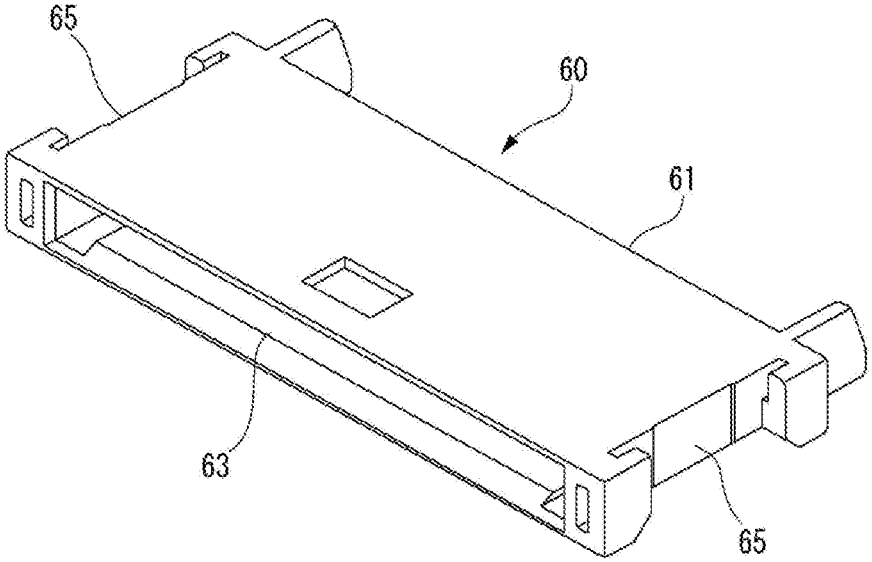
FIG. 31 is a perspective view of a mating housing in FIG. 4.
Figure 32:
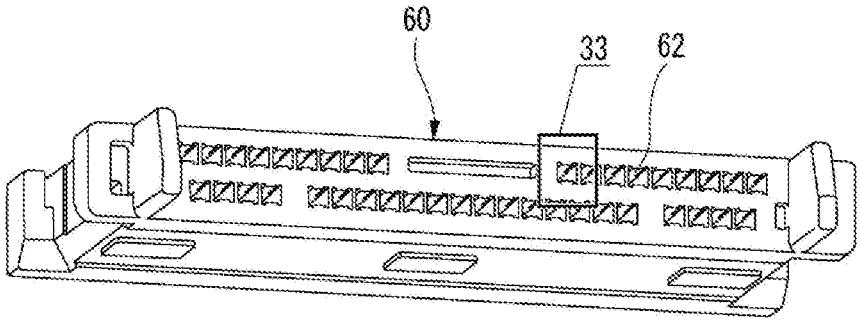
FIG. 32 is a perspective view of the mating housing as viewed from rear.

Next, the mating housing 60 will be described with reference to FIGS. 31 to 38. As shown in FIG. 31, the mating housing 60 includes a substantially rectangular parallelepiped housing main body 61. As can be seen from FIGS. 32 and 36, the housing main body 61 includes a plurality of upper and lower terminal accommodating holes 62 in the rear part. As can be seen from FIGS. 31 and 36, the housing main body 61 includes a fitting space 63 in the front part that is continuous with the plurality of upper and lower terminal accommodating holes 62.

Figure 33:
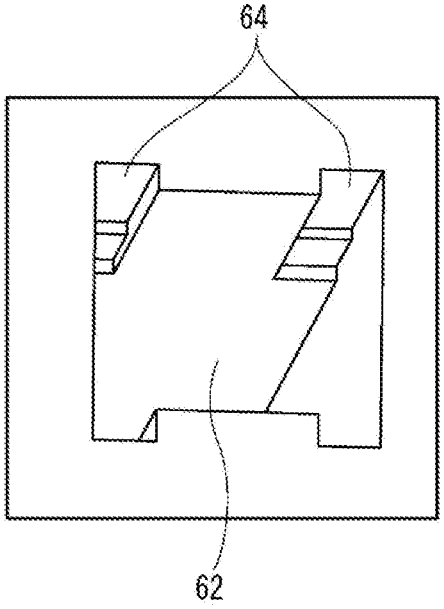
FIG. 33 is an enlarged view of the inside of a frame indicated by a reference numeral 33 in FIG. 32.
Figure 36:
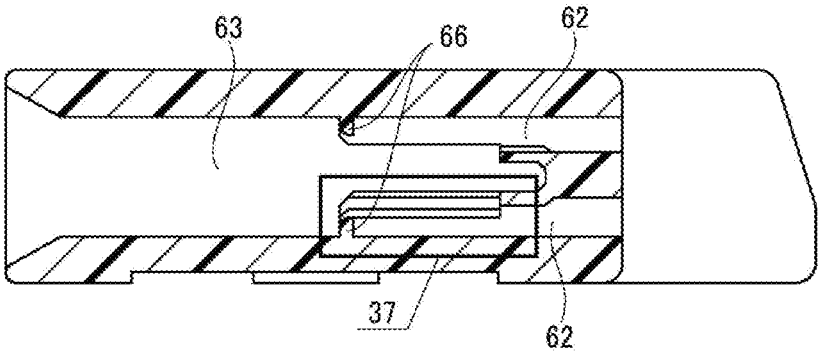
FIG. 36 is a cross-sectional view taken along a line 36-36 in FIG. 35.
Figure 37:
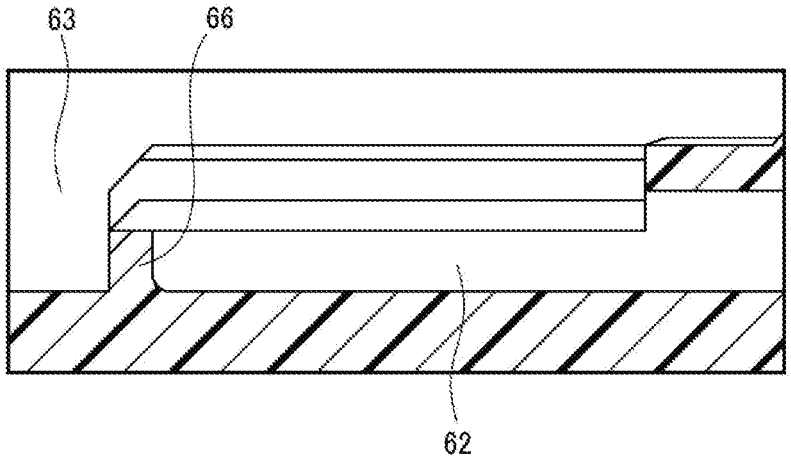
FIG. 37 is an enlarged view of the inside of a frame indicated by a reference numeral 37 in FIG. 36.
Figure 38:
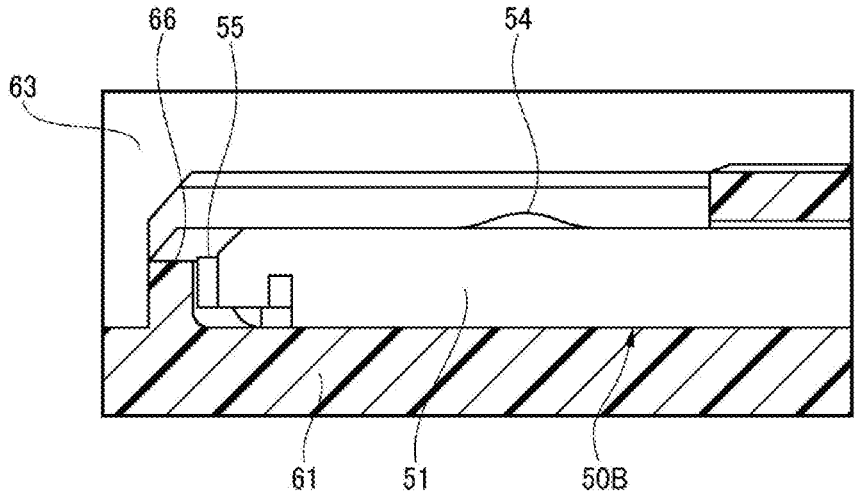
FIG. 38 corresponds to FIG. 37 in a state in which the mating terminal is accommodated in the terminal accommodating hole of the mating housing.
Figure 39:
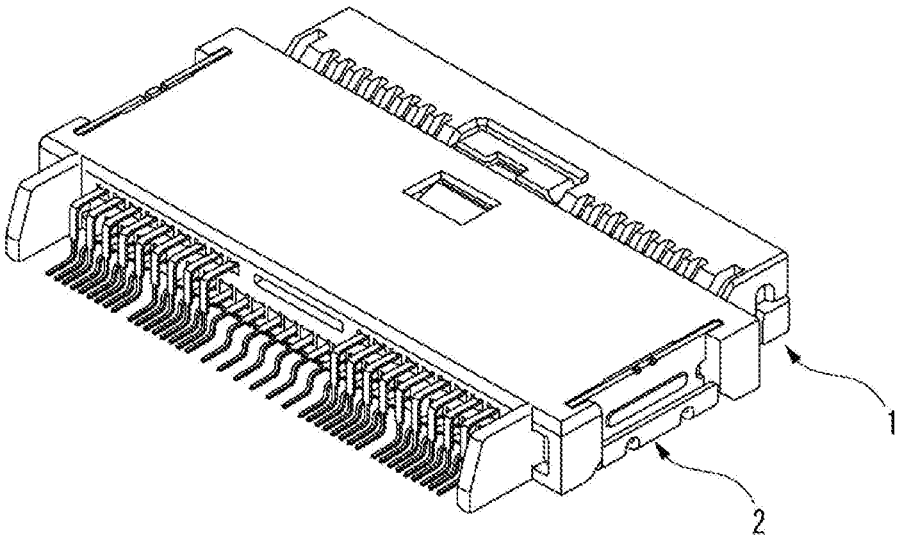
FIG. 39 is a perspective view showing a state in which the housing and the mating housing are fitted with each other.
Figure 40:
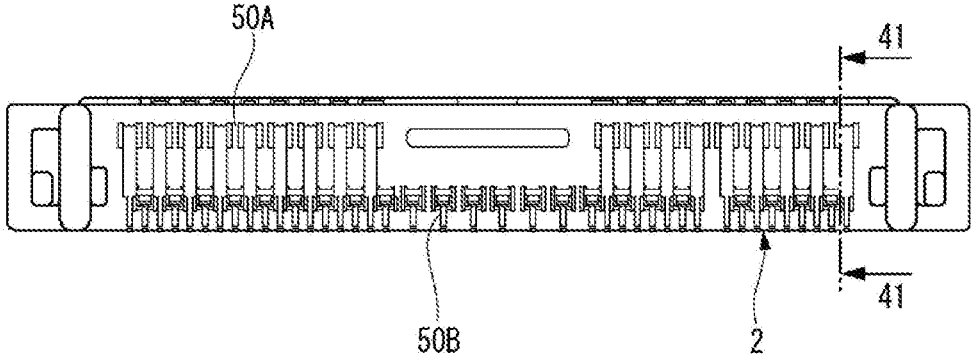
FIG. 40 is a back view of the mating housing in a state in which the housing and the mating housing are fitted with each other.

As shown in FIG. 33, the press-fitting step portions 64 are formed on upper and lower walls of rear ends of the terminal accommodating holes 62. As shown in FIGS. 36 and 37, the terminal accommodating holes 62 include stopper portions 66 protruding from the front end of the terminal accommodating holes 62. The mating terminal 50 is inserted into the terminal accommodating holes 62 until the front end (the protective wall 55) of the connecting portion 51 abuts on the stopper portions 66 (see FIG. 38). Accordingly, the mating terminal 50 is accommodated in normal positions of the terminal accommodating holes 62. When the mating terminal 50 is in the normal positions, the spring plate 54 of the connecting portion 51 faces the fitting space 63 (see FIG. 38).

Figure 34:
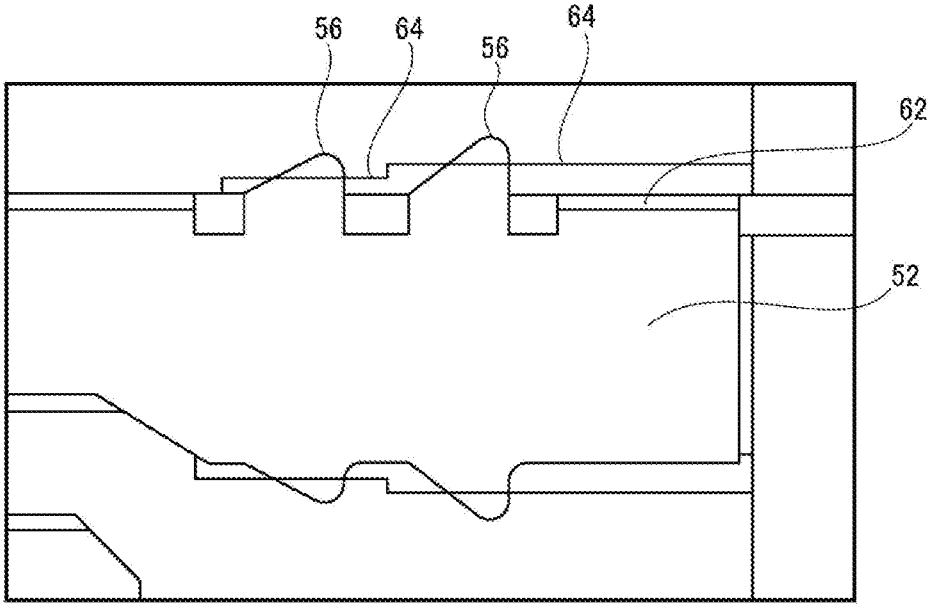
FIG. 34 shows a state in which the press-fitting portion of a mating terminal is press-fitted into a terminal accommodating hole of the mating housing.
Figure 35:
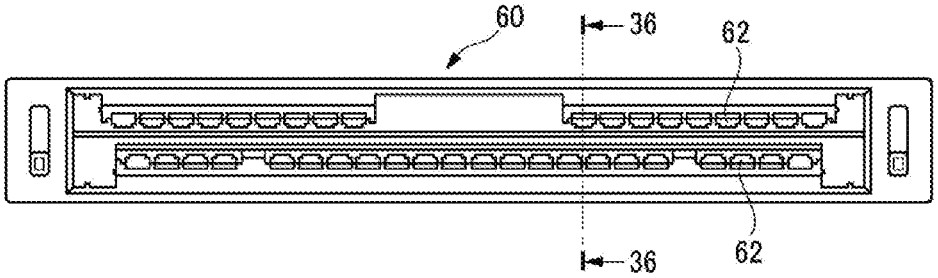
FIG. 35 is a back view of the mating housing.

When the mating terminal 50 is accommodated in the normal positions, as shown in FIG. 34, the claw portions 56 of the press-fitting portion 52 of the mating terminal 50 are press-fitted into the press-fitting step portions 64. Accordingly, the mating terminal 50 is held (fixed) in the normal positions of the terminal accommodating holes 62 and the backlash between the mating terminal 50 and the mating housing 60 is prevented.

As shown in FIG. 31, the mating housing 60 includes a pair of attachment portions 65 that attach the pair of pegs 70 (see FIG. 4). When the pair of pegs 70 are attached to the pair of attachment portions 65, the mating housing 60 is mounted and fixed to the substrate by the pair of pegs 70. The mating connector 2 is described as above.

Next, a fitted state in which the connector 1 and the mating connector 2 are fitted will be described with reference to FIGS. 39 to 42. As can be seen from FIGS. 39 and 41, the connector 1 and the mating connector 2 are brought into the fitted state by inserting the connector 1 into the fitting space 63 of the mating connector 2.

Figure 42:
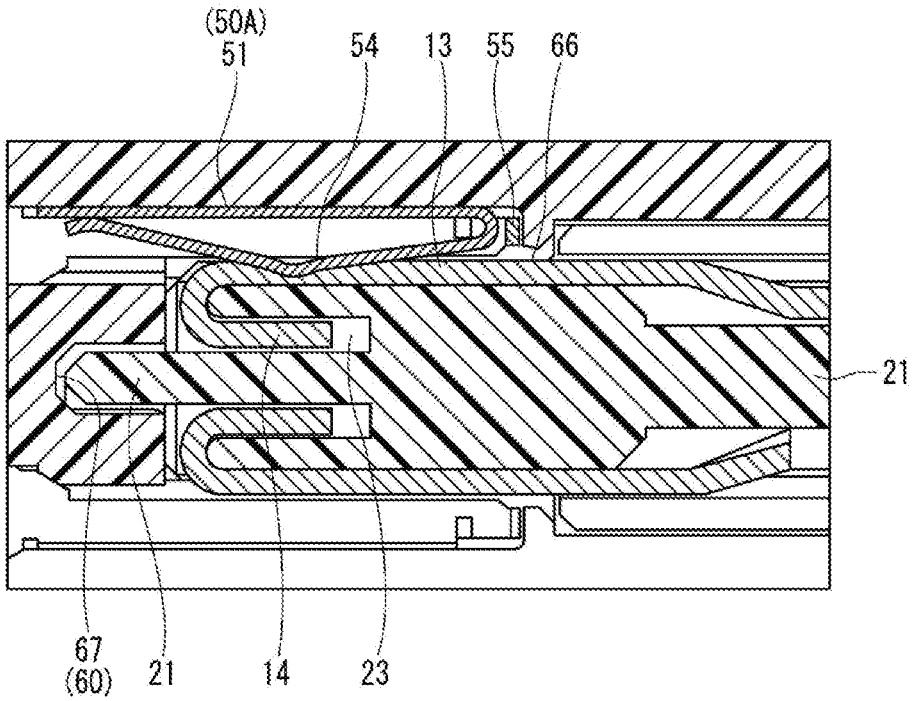
FIG. 42 is an enlarged view of a contact point between the electric wire and the mating terminal in FIG. 41.

In the fitted state, as shown in FIG. 42, the contact portion 13 of the electric wires 10 of the connector 1 and the spring plate 54 of the mating terminal 50 of the mating connector 2 are in press contact with each other in the upper-lower direction. Accordingly, the electric wires 10 and the mating terminal 50 are electrically connected.

Figure 41:
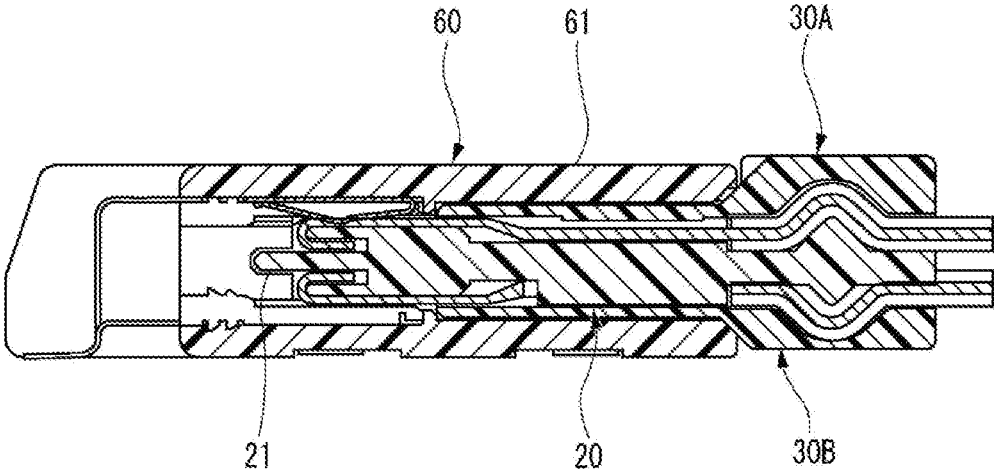
FIG. 41 is a cross-sectional view taken along a line 41-41 in FIG. 40.

Further, as shown in FIGS. 41 to 42, the end edge on the front side of the housing 20 (the housing main body 21) is inserted into a groove provided in the mating housing 60. The edge may also be press-fitted into the groove. Accordingly, the backlash between the housing 20 and the mating housing 60 is prevented.

According to the connector 1 in the embodiment of the present invention described above, the height of the connector 1 can be reduced by eliminating a terminal that contacts the mating terminal 50 and bringing the conductor core wire 11 of the electric wire 10 into contact with the mating terminal 50. Further, the electric wires 10 can be reliably held in the housing 20 simply by placing the electric wires 10 in the wire accommodating portions opened upward and drawing the electric wires 10 rearward. Accordingly, it is possible to provide the connector 1 having a reduced height and good flexibility of assembly of the electric wires 10 without the terminal.

Further, a contact area can be ensured and an increase in contact resistance can be prevented by bringing the mating terminal 50 into contact with the planar portion of the contact portion 13 of the electric wires 10.

Other Embodiments

The present invention is not limited to the above embodiment and various modifications can be adopted within the scope of the present invention. For example, the present invention may be appropriately modified, improved or the like. In addition, materials, shapes, sizes, numbers, arrangement positions, and the like of elements in the embodiment described above are optional as long as the present invention can be achieved, and the present invention is not limited thereto.

In the above embodiment, the cover 30 and the connector cover 40 are formed separately (see FIG. 2). In contrast, the cover 30 and the connector cover 40 may be integrally formed.

Herein features of the embodiment of the connector 1 according to the present invention described above will be briefly summarized in the following [1] to [3].

[1] A connector (1) includes:

an electric wire (10) having a conductor core wire (11) and a cover (12) which covers the conductor core wire (11), the conductor core wire (11) exposed from the electric wire (10) functioning as a contact portion (13) configured to be connected with a mating terminal; and a plate-shaped housing (20) having an electric wire accommodating portion which is opened upward and which is configured to hold the electric wire (10), wherein a folded portion (14) folded back to one side toward the cover (12) is provided at a tip end part of the contact portion (13), wherein a groove (23) that is opened forward and extends in a front-rear direction of the housing (20) is formed on a front end surface located at a front end of the wire accommodating portion of the housing (20); and wherein the folded portion (14) is engaged to the groove (23) so that the electric wire (10) is held by the housing (20).

[2] The connector [1] according to the above [1], wherein the electric wire (10) placed in the wire accommodating portion such that the folded portion (14) is located in front of the groove (23) is drawn rearward relative to the housing (20) so that the folded portion (14) is entered into the groove (23).

[3] The connector [1] according to the above [1] or [2], wherein a planar portion configured to contact the mating terminal is provided on a surface of another side of the contact portion that is opposite to the one side of the contact portion (13).

What is claimed is:

1. A connector comprising:

an electric wire having a conductor core wire and a cover which covers the conductor core wire, the conductor core wire exposed from the electric wire functioning as a contact portion configured to be connected with a mating terminal; and a plate-shaped housing having an electric wire accommodating portion which is opened upward and which is configured to hold the electric wire, wherein a folded portion folded back to one side toward the cover is provided at a tip end part of the contact portion;

wherein a groove that is opened forward and extends in a front-rear direction of the housing is formed on a front end surface located at a front end of the wire accommodating portion of the housing; and wherein the folded portion is engaged to the groove so that the electric wire is held by the housing.

2. The connector according to claim 1, wherein the electric wire placed in the wire accommodating portion such that the folded portion is located in front of the groove is drawn rearward relative to the housing so that the folded portion is entered into the groove.

3. The connector according to claim 1, wherein a planar portion configured to contact the mating terminal is provided on a surface of another side of the contact portion that is opposite to the one side of the contact portion.

4. The connector according to claim 1, wherein the housing includes a body between the electric wire accommodating portion and the rib, the body being disposed between the folded back portion and a portion of the conductor wire adjacent thereto to retain the electric wire in the housing.

5. The connector according to claim 1, wherein the electric wire accommodating portion is provided on an upper face of the housing and extends until the front end surface of the housing in the front-rear direction of the housing;

wherein the folded portion abuts on the front end surface of the housing; and wherein the groove is located on a lower side of the housing opposed to the upper face with respect to a bottom surface of the electric wire accommodating portion.

* * * * *